US012747519B2

(12) United States Patent
Minor

(10) Patent No.: US 12,747,519 B2
(45) Date of Patent: Sep. 29, 2026

(54) MICROPOROUS POLYETHYLENE FILAMENTS

(71) Applicant: W. L. Gore & Associates, Inc., Newark, DE (US)

(72) Inventor: Raymond B. Minor, The Villages, FL (US)

(73) Assignee: W. L. Gore & Associates, Inc., Newark, DE (US)

( * ) Notice: Subject to any disclaimer, the term of this patent is extended or adjusted under 35 U.S.C. 154(b) by 187 days.

(21) Appl. No.: 18/036,595

(22) PCT Filed: Nov. 10, 2021

(86) PCT No.: PCT/US2021/058697
§ 371 (c)(1),
(2) Date: May 11, 2023

(87) PCT Pub. No.: WO2022/103783
PCT Pub. Date: May 19, 2022

(65) Prior Publication Data

US 2024/0011197 A1 Jan. 11, 2024

Related U.S. Application Data

(60) Provisional application No. 63/112,956, filed on Nov. 12, 2020.

(51) Int. Cl.
*D01F 6/04* (2006.01)
*D01D 5/247* (2006.01)
(Continued)

(52) U.S. Cl.
CPC ..... *D01F 6/04* (2013.01); *D01D 5/247* (2013.01); *D01D 5/426* (2013.01); *D03D 13/008* (2013.01);
(Continued)

(58) Field of Classification Search
CPC ..... D01F 5/247; D01F 6/04; A61C 15/041
See application file for complete search history.

(56) References Cited

U.S. PATENT DOCUMENTS 5,032,450 A * 7/1991 Rechlicz ..... C08J 7/043 428/196
5,043,216 A 8/1991 Misoo et al.
(Continued)

FOREIGN PATENT DOCUMENTS

CN 101098663 A 1/2008
EP 0662388 A2 7/1995
(Continued)

OTHER PUBLICATIONS

Machine translation JP 2002-537489 (Year: 2025).*
(Continued)

*Primary Examiner* — Alexandre F Ferre

(57) ABSTRACT

Polyethylene (PE) and porous PE filaments and methods of manufacturing such filaments are disclosed for various applications, including dental floss, medical sutures, and in garments or other textile fabrics. The PE filaments may be expanded, folded, and/or otherwise manipulated to achieve desired characteristics, including porosity. The PE filaments may be light-weight, easy to grip, easy-gliding, non-shredding, and comfortable.

16 Claims, 3 Drawing Sheets

(51) Int. Cl.

| | |
|---|---|
| ***D01D 5/42*** | (2006.01) |
| ***D03D 13/00*** | (2006.01) |
| ***D03D 15/283*** | (2021.01) |
| ***D03D 15/30*** | (2021.01) |
| ***D03D 15/573*** | (2021.01) |

(52) U.S. Cl.
CPC ..... *D03D 15/283* (2021.01); *D03D 15/30* (2021.01); *D03D 15/573* (2021.01); *D10B 2321/0211* (2013.01); *D10B 2331/02* (2013.01); *D10B 2401/063* (2013.01); *D10B 2401/10* (2013.01); *D10B 2509/00* (2013.01)

(56) References Cited

U.S. PATENT DOCUMENTS

| | | | | |
|---|---|---|---|---|
| 5,407,623 | A | 4/1995 | Zachariades et al. | |
| 5,518,012 | A * | 5/1996 | Dolan | A61K 8/02 132/321 |
| 5,718,251 | A | 2/1998 | Gray et al. | |
| 5,878,758 | A | 3/1999 | Bacino et al. | |
| 6,080,481 | A | 6/2000 | Ochs et al. | |
| 9,920,457 | B2 | 3/2018 | Kim | |
| 2002/0139386 | A1 | 10/2002 | Ochs et al. | |
| 2006/0243297 | A1 | 11/2006 | Brown | |
| 2006/0243298 | A1 | 11/2006 | Hamant | |
| 2007/0204877 | A1 | 9/2007 | Dolan et al. | |
| 2008/0156345 | A1 * | 7/2008 | Snijder | B29C 55/005 264/103 |
| 2009/0188520 | A1 | 7/2009 | Brown | |
| 2013/0112621 | A1 | 5/2013 | Zheng et al. | |
| 2014/0212612 | A1 | 7/2014 | Sbriglia | |
| 2016/0031130 | A1 | 2/2016 | Sbriglia | |
| 2016/0032044 | A1 | 2/2016 | Sbriglia et al. | |
| 2016/0032069 | A1 | 2/2016 | Sbriglia | |
| 2016/0032071 | A1 | 2/2016 | Sbriglia et al. | |

FOREIGN PATENT DOCUMENTS

| | | | | |
|---|---|---|---|---|
| JP | 06-041240 | A | 2/1994 | |
| JP | 06-123005 | A | 5/1994 | |
| JP | H06123005 | A * | 5/1994 | |
| JP | 08-041240 | A | 2/1996 | |
| JP | 2002537489 | A * | 11/2002 | A61K 8/027 |
| JP | 3609419 | B2 | 1/2005 | |
| WO | 95/34252 | A1 | 12/1995 | |
| WO | 2006/074823 | A1 | 7/2006 | |
| WO | 2008/108767 | A1 | 9/2008 | |

OTHER PUBLICATIONS

International Search Report and Written Opinion received for PCT Patent Application No. PCT/US2021/058697, mailed on Mar. 14, 2022, 10 pages.

International Preliminary Report on Patentability received for PCT Patent Application No. PCT/US2021/058697, mailed on May 25, 2023, 7 pages.

* cited by examiner

MICROPOROUS POLYETHYLENE FILAMENTS

CROSS-REFERENCE TO RELATED APPLICATION

This application is a national phase application of PCT Application No. PCT/US2021/058697, internationally filed on Nov. 10, 2021, which claims the benefit of Provisional Application No. 63/112,956, filed Nov. 12, 2021, which are incorporated herein by reference in their entireties for all purposes.

FIELD

The present invention relates generally to polyethylene (PE) polymers, such as ultra high molecular weight polyethylene (UHMWPE) polymers, and more specifically to PE filaments for various applications, including dental floss, medical sutures, and in fabrics or garments and methods of manufacturing the same.

BACKGROUND

Synthetic fibers, such as those used for dental floss, medical suture, and fabric thread, should have various desirable material properties. By way of example, dental floss should be abrasion resistant such that it does not shred, fray, or otherwise break during use when passed between a user's teeth. Medical sutures, for example, should be biocompatible and exhibit suitable strength and knot holding properties for the particular application. Fabric thread, for example, should have sufficient durability and strength for the particular application. What is needed in the art is a polyethylene polymer fiber suitable for the particular application.

SUMMARY

Porous PE filaments and methods of manufacturing such filaments are disclosed for various applications, including dental floss or in fabrics or garments. The PE filaments may be expanded, folded, and/or otherwise manipulated to achieve desired characteristics. The PE filaments may be easy to grip, easy-gliding, non-shredding, and comfortable.

According to one example ("Example 1"), a microporous monofilament is provided including a continuous polyethylene filament having a width of 0.2 mm to 8.0 mm, a thickness of 0.02 mm to 0.35 mm, and a porosity of 15% to 90%.

According to yet another example ("Example 2"), a fabric is provided including at least one microporous monofilament, the at least one microporous monofilament including a continuous polyethylene filament having a width of 0.2 mm to 8.0 mm, a thickness of 0.02 mm to 0.35 mm, and a porosity of 15% to 90%.

According to yet another example ("Example 3"), a method of manufacturing a microporous monofilament is provided including providing a polyethylene tape or membrane, expanding the polyethylene tape or membrane in at least one direction to increase a porosity of the tape or membrane to 15% to 90%, and cutting the tape or membrane into a monofilament, wherein the method lacks any compression steps that would reduce the porosity.

The foregoing Examples are just that and should not be read to limit or otherwise narrow the scope of any of the inventive concepts otherwise provided by the instant disclosure. While multiple examples are disclosed, still other embodiments will become apparent to those skilled in the art from the following detailed description, which shows and describes illustrative examples. Accordingly, the drawings and detailed description are to be regarded as illustrative in nature rather than restrictive in nature.

BRIEF DESCRIPTION OF THE DRAWINGS

The accompanying drawings are included to provide a further understanding of the disclosure and are incorporated in and constitute a part of this specification, illustrate embodiments, and together with the description serve to explain the principles of the disclosure.

DETAILED DESCRIPTION

Definitions and Terminology

Figure 1:
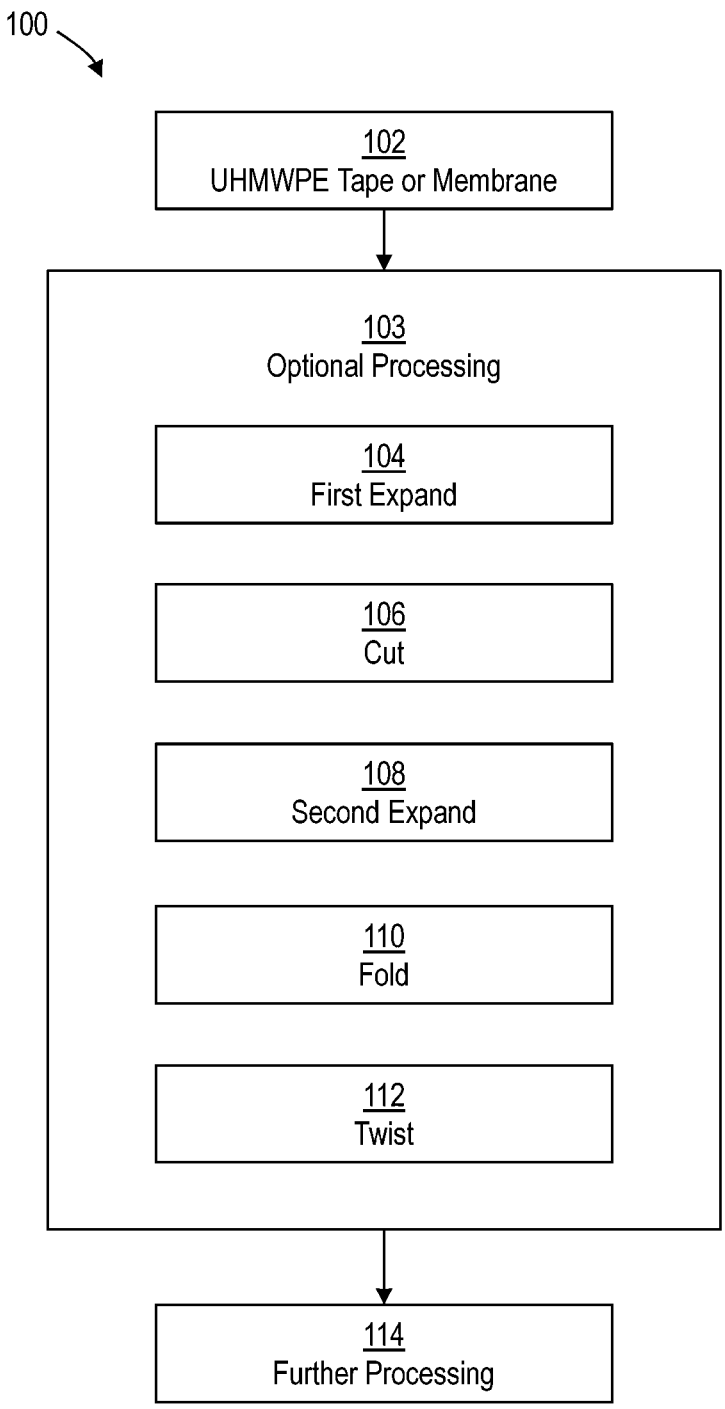
FIG. 1 is a flow chart showing an exemplary method for manufacturing a PE filament in accordance with an embodiment.

This disclosure is not meant to be read in a restrictive manner. For example, the terminology used in the application should be read broadly in the context of the meaning those in the field would attribute such terminology.

With respect to terminology of inexactitude, the terms "about" and "approximately" may be used, interchangeably, to refer to a measurement that includes the stated measurement and that also includes any measurements that are reasonably close to the stated measurement. Measurements that are reasonably close to the stated measurement deviate from the stated measurement by a reasonably small amount as understood and readily ascertained by individuals having ordinary skill in the relevant arts. Such deviations may be attributable to measurement error, differences in measurement and/or manufacturing equipment calibration, human error in reading and/or setting measurements, minor adjustments made to optimize performance and/or structural parameters in view of differences in measurements associated with other components, particular implementation scenarios, imprecise adjustment and/or manipulation of objects by a person or machine, and/or the like, for example.

Description of Various Embodiments

Persons skilled in the art will readily appreciate that various aspects of the present disclosure can be realized by any number of methods and apparatuses configured to perform the intended functions. It should also be noted that the accompanying drawing figures referred to herein are not necessarily drawn to scale but may be exaggerated to illustrate various aspects of the present disclosure, and in that regard, the drawing figures should not be construed as limiting.

Referring to FIG. 1, an exemplary method 100 is provided for manufacturing a PE filament, such as a UHMWPE filament, suitable for use as dental floss. It is also within the scope of the present disclosure to use the PE filament for other applications, such as in garments or other textile fabrics. The method 100 may lack any compression steps that would reduce and/or destroy micropores in the filament.

In a providing step 102 of method 100, a PE tape or membrane is provided. The PE polymer of the tape or membrane may vary in its branching, crystal structure, molecular weight, and/or comonomer content. Suitable PE polymers include, for example, UHMWPE having a molecular mass greater than 0.5 million amu, high molecular weight polyethylene (HMWPE), high-density polyethylene (HDPE), linear low-density polyethylene (LLDPE), low-density polyethylene (LDPE), and mixtures thereof. The PE polymer of the tape or membrane may be a homopolymer of ethylene or a copolymer of ethylene and at least one comonomer. In certain embodiments, the at least one comonomer may be an alkyl-branched comonomer and/or an alpha-olefin or cyclic olefin having 3 to 20 carbon atoms. Suitable comonomers include but are not limited to 1-butene, 1-pentene, 1-hexene, 1-heptene, 1-octene, cyclohexene, and dienes with up to 20 carbon atoms (e.g. butadiene or 1,4-hexadiene). The comonomers may be present in the copolymer in an amount from 0.001 mol % to 10 mol %, or from 0.01 mol % to 5 mol %, or from 0.1 mol % to 1 mol %. The PE tape or membrane may be a porous material, more specifically a microporous material containing interconnected pores. In certain embodiments, the PE tape may be formed by paste-processing the PE polymer, which may involve mixing PE particles with a lubricant, calendaring the lubricated particles into a tape while maintaining a temperature below the melt temperature of the PE polymer and the boiling point of the lubricant, and drying the tape to remove the lubricant. In other embodiments, the PE tape may be formed by gel-processing the PE polymer or by another suitable processing technique. The PE membrane may be formed by expanding the PE tape.

The PE tape or membrane from the providing step 102 may be subjected to one or more optional processing steps 103. As shown in FIG. 1, the optional processing steps 103 include a first expanding step 104, a cutting step 106, a second expanding step 108, a folding step 110, and a twisting step 112, each of which is described further below.

In the first expanding step 104 of method 100, the PE tape or membrane may be optionally expanded and/or stretched in one or more directions (e.g., a machine direction (MD) and/or a transverse direction (TD)) to produce an expanded PE (ePE) tape or membrane taking care to minimize any loss of porosity and in many cases at least maintaining if not increasing the level of porosity of the tape or membrane. One technique to help with this is to hold one direction steady while expanding in the other direction. The first expanding step 104 may involve passing the PE filament over a series of rotating heated rollers or heated plates at temperatures below the melt temperature of the PE polymer, such as 120 degrees C. to 140 degrees C., more specifically 125 degrees C. to 130 degrees C. The first expanding step 104 may be performed at stretch rates of 0.1%/sec to 100%/sec, more specifically 0.3%/sec to 10%/sec, more specifically 0.5%/sec to 3.5%/sec. In each direction, the PE tape or membrane may be expanded by 1.01 times to 10 times, more specifically 1.05 times to 2.5 times, more specifically 1.05 times to 1.5 times. The resulting ePE tape or membrane from the first expanding step 104 may be more porous than the microporous PE tape or membrane from the providing step 102 and may have nodes interconnected by fibrils.

In the cutting step 106 of method 100, the PE tape or membrane may be optionally slit lengthwise into a ribbon-shape filament having a desired width, such as by passing the tape through a series of gapped blades set the desired width apart. The desired width after the cutting step 106 may be 0.1 mm to 30 mm, more specifically 0.1 mm to 10 mm, more specifically 0.2 mm to 8.0 mm, more specifically 0.25 mm to 7.5 mm, more specifically 0.3 mm to 6.0 mm, more specifically 0.3 mm to 3.5 mm, more specifically 0.5 mm to 3.0 mm, and more specifically 0.8 mm to 2.5 mm. In certain embodiments, the PE filament may remain as a single strand or monofilament. However, it is also within the scope of the present disclosure to fuse, braid, or otherwise bundle the PE filament with other strands to produce a multifilament.

In the second expanding step 108 of method 100, the PE filament may be optionally expanded and/or stretched in the machine direction (MD) to produce an expanded PE (ePE) filament taking care to maintain desired levels of porosity. The second expanding step 108 may involve passing the PE filament over a series of rotating heated rollers or heated plates at temperatures below the melt temperature of the PE polymer, such as 120 degrees C. to 140 degrees C., more specifically 125 degrees C. to 130 degrees C. The second expanding step 108 may be performed at stretch rates of 0.1%/sec to 100%/sec, more specifically 0.3%/sec to 10%/sec, more specifically 0.5%/sec to 3.5%/sec. The PE filament may be expanded by 1.01 times to times, more specifically 1.05 times to 2.5 times, more specifically 1.05 times to 1.5 times. The resulting ePE filament from the second expanding step 108 may be more or less porous than the PE tape or membrane from the providing step 102 or the previous, first expanding step 104 and may have nodes interconnected by fibrils. In certain embodiments of method 100, both the first and second expanding steps 104 and 108 may be performed. In other embodiments of method 100, only one of the first or second expanding steps 104 or 108 may be performed.

In the folding step 110 of method 100, the PE or ePE filament may be optionally folded lengthwise into a narrower, thicker filament. The folded PE or ePE filament may have a width after the folding step 110 of 0.2 mm to 8.0 mm, more specifically 0.25 mm to 7.5 mm, more specifically 0.3 mm to 6.0 mm, more specifically mm to 3.5 mm, more specifically 0.5 mm to 3.0 mm, more specifically 0.8 mm to 2.5 mm, and more specifically 1.0 mm to 2.5 mm. The PE or ePE filament may have a thickness after the folding step 110 of 0.02 mm to 0.35 mm, more specifically 0.02 mm to 0.25 mm, more specifically 0.03 mm to 0.15 mm, and more specifically 0.04 mm to 0.10 mm.

In the twisting step 112 of method 100, the PE or ePE filament may be optionally twisted. The PE or ePE filament may be twisted a desired number of turns, such as 10 turns per meter to 1000 turns per meter, more specifically 250 turns per meter to 750 turns per meter. This twisting step 112 may densify the filament. It is also within the scope of the present disclosure to modify this twisting step 112 to perform other physical manipulations, such as pressing the filament, for example. This twisting step 112 may be performed according to U.S. Pat. No. 5,989,709, for example.

In a further processing step 114 of method 100, the PE or ePE filament may be processed for its desired application. In one embodiment, the PE or ePE filament may be sterilized, flavored, embossed, wound onto a spool, and/or packaged for use as dental floss during the further processing step 114. The PE or ePE dental floss may be surprisingly easy to grip even without wax, easy-gliding, non-shredding (especially when provided as a monofilament rather than a multifilament), and comfortable.

In other embodiments, the PE or ePE filament may be incorporated into a garment or other textile fabric during the further processing step 114. The fabric includes both woven and knitted fabrics. The fabric may also include one or more monofilament yarns, multifilament yarns, or a combination thereof. Such yarns may be formed from the above-described PE or ePE filament as well as other materials, such as wool, cotton, silk, flax, hemp, hair from various animals, angora, sisal, raymie, acrylic, polyester, polyamide, polyaramid, polyurethane, acetate, rayon, polybenzimidazole, polybenzoxazole, lyocell, modacrylic, polyvinylidene chloride, carbon, glass, cellulose, cellulose acetate, cellulose esters, elastic fibers, or a combination thereof.

The PE or ePE filament may be lighter than current ePTFE dental floss, because PE is over 50% lighter than PTFE. In certain embodiments, the PE or ePE filament may have a weight per length (i.e., linear density) less than 1040 dTex, more specifically 90 dTex to 1040 dTex, more specifically 100 dTex to 1000 dTex, more specifically 200 dTex to 700 dTex, more specifically 250 dTex to 650 dTex, more specifically 300 dTex to 600 dTex, and more specifically 350 dTex to 550 dTex. By comparison, current ePTFE dental floss of similar porosity may have a weight per length exceeding 1040 dTex.

Other characteristics of the PE or ePE filament may be suitable for use as dental floss. The PE or ePE filament may have a bulk density of 0.1 g/cc to 0.8 g/cc, more specifically 0.2 g/cc to 0.7 g/cc, more specifically 0.14 g/cc to 0.76 g/cc. The PE or ePE filament may have a porosity of 15% to 90%, more specifically 20% to 80%, more specifically 19% to 76%, and more specifically 30% to 60%. The PE or ePE filament may have a break strength of 3 N to 50 N, more specifically 5 N to 30 N, and more specifically 10 N to 25 N. The PE or ePE filament may have a tenacity of 0.5 cN/dTex to 20 cN/dTex, more specifically 0.7 cN/dTex to 18 cN/dTex, more specifically 1.0 cN/dTex to 10 cN/dTex, more specifically 1.5 cN/dTex to 8 cN/dTex. The PE or ePE filament may have a tensile strength of 0.1 GPa to 1.5 GPa, more specifically 0.2 GPa to 0.8 GPa, more specifically 0.3 GPa to 0.6 GPa. The PE or ePE filament may have an elongation at maximum load of 1% to 100%, more specifically 5% to 95%, more specifically 10% to 75%.

In dental floss applications, despite having a lower tensile strength than full-density filaments, the microporous structure of the present filament is believed to accommodate compression of the filament (e.g., when traveling through a tight space between teeth), and this compression is believed to enhance resistance to shredding or breakage. Furthermore, the microporous structure of the present filament provides for less stiffness of the filament and provides additional comfort to the gums as well as makes the filament more comfortable to grip. In fabric applications, the filament may produce light-weight materials having desired properties such as low air permeability, low wet pick up, and suitable hand.

Test Methods

It should be understood that although certain methods and equipment are described below, other methods or equipment determined suitable by one of ordinary skill in the art may be alternatively utilized.

Filament Weight Per Length (dTex)

A 9-meter length of filament was obtained by wrapping the filament ten lengths around two pins separated by 0.9 meters. The 9-meter length was then weighed on a scale with precision to 0.0001 grams. This weight was then multiplied by 1000 to give the weight per length in terms of denier (g/9000 m). This denier measurement was then multiplied by 1.1111 to give the weight per length in units of dTex.

Filament Width (mm)

Filament width was measured in a conventional manner utilizing a 10 times eye loop having gradations to the nearest 0.1 mm. Three measurements were taken and averaged to determine the width to the nearest 0.05 mm.

Filament Thickness (mm)

Filament thickness (or height) was measured utilizing a snap gauge accurate to the nearest 0.001 mm. Care was taken to not to compress the filament with the snap gauge. Three measurements were taken and averaged to the nearest 0.001 mm.

Filament Density (g/cc)

Filament density was calculated utilizing the previously measured filament weight per length, filament width and filament thickness using the following formula:

$$\text{Density (g/cc)} = \frac{\text{Weight per Length } (dTex)}{\text{Width (mm)} * \text{Thickness (mm)} * 10{,}000}$$

Filament Porosity (%)

Filament porosity is the amount of air volume compared to the total volume of the sample (air plus the polymer). Full density polyethylene or UHMWPE was assumed to be 0.94 g/cc. Full density polytetrafluoroethylene or PTFE was assumed to be 2.18 g/cc. Filament porosity (%) was calculated using the following formula:

$$\text{Filament Porosity (\%)} = 100*(1-(\text{Filament Density}/\text{Full Density}))$$

Filament Break Strength (N) and Elongation (%)

The filament break strength was the measurement of the maximum load needed to break (rupture) the filament. The break strength was measured by a tensile tester, such as an Instron Machine of Canton, Mass. The Instron machine was outfitted with fiber (horn type) jaws that are suitable for securing fibers and strand goods during the measurement of tensile loading. The cross-head speed of the tensile tester was 25.4 cm per minute. The gauge length was 25.4 cm. Five measurements of each fiber type were taken with the average reported in units of Newtons. The elongation of the filament before breakage at the maximum load was also measured. Five elongation measurements of each fiber type were taken with the average reported in units of percent.

Filament Tenacity (cN/dTex)

Filament tenacity is the break strength of the filament normalized to the weight per length of the fiber. Filament tenacity (cN/dTex) was calculated using the following formula:

$$\text{Tenacity } (cN/dTex) = \frac{\text{Break Strength } (N) * 100}{\text{Weight per Length } (dTex)}$$

Filament Tensile Strength (GPa)

Filament tensile strength is the break strength of the filament normalized to cross sectional area. Full density polyethylene or UHMWPE was assumed to be 0.94 g/cc, and a tenacity of 1 cN/dTex would equal 13,633 psi. Filament tensile strength (GPa) was calculated using the following formula:

$$\text{Tesnile Strength (GPa)} = \frac{\text{Filament Tenacity } (cN/dTex) * 13{,}633 \text{ psi} * 1 \text{ GPa}}{145{,}038 \text{ psi}}$$

SEM Sample Preparation Method

Cross-section SEM samples were prepared by spraying each filament sample with liquid nitrogen and then cutting the sprayed samples with a diamond knife in a Leica Ultracut UCT, available from Leica Microsystems, Wetzlar, Germany.

Matrix Tensile Strength (MTS)

To determine MTS, a sample membrane was cut in the longitudinal and transverse directions using an ASTM D412-Dogbone Die Type F (DD412F). Tensile break load was measured using an INSTRON® 5500R (Illinois Tool Works Inc., Norwood, MA) tensile test machine equipped with flat-faced grips and a "200 lb" (~90.72 kg) load cell. The gauge length for the grips was set to 8.26 cm and a strain rate of 0.847 cm/s. After placing the sample in the grips, the sample was retracted 1.27 cm to obtain a baseline followed by a tensile test at the aforementioned rate. Two samples for each condition were tested individually and the average of the maximum load (i.e., the peak force) measurements was used for the MTS calculation. The longitudinal and transverse MTS were calculated using the following equation:

$$\text{Matrix Tensile Strength } (MTS) = \frac{\text{Maximum Load}}{\text{Cross-Sectional Area}} * \frac{\text{Full Density}}{\text{Sample Density}}$$

EXAMPLES

Inventive Example A

ΔPE membrane including UHMWPE was obtained having a mass of 8.8 grams/m$^2$, a porosity of 76%, and matrix tensile strengths of 24,600 psi in the longitudinal direction and 13,200 psi in the transverse direction.

This membrane was then slit to create a cross-section of 3.0 mm wide by mm thick filament having a weight per length of 336 dtex and a density of 0.23 g/cc yielding a porosity of 76% (assuming full density PE to be 0.94 g/cc). This filament was subsequently folded through a 2.0 mm wide eyelet. The folded filament possessed the following properties: width of 1.8 mm, height (or thickness) of 0.089 mm, weight per length of 336 dtex, bulk density of 0.21 g/cc, porosity of 78%, break strength of 6.67 N, tenacity of 1.99 cN/dtex, tensile strength of 0.19 GPa, and elongation at maximum load of 3.0%.

This folded filament was easy to grip and glided easily between teeth without any tendency to shred or break while flossing. Furthermore, the porosity in the filament provided for less stiffness of the filament and provided additional comfort to the gums as well as made the filament more comfortable to grip.

Inventive Example B

A 5.3 mm wide filament was slit from the membrane of Example A. The slit membrane filament was then stretched across a heated plate set to 140 degrees C. at a stretch ratio of 1.15:1 with a stretch rate of 3.5%/sec. This first stretch was followed by a second stretch across a heated plate set to 140 degrees C. at a stretch ratio of 1.10:1 with a stretch rate of 2.6%/sec. This second stretch was followed by a third stretch across a heated plate set to 140 degrees C. at a stretch ratio of 1.10:1 with a stretch rate of 2.9%/sec. This third stretch was followed by a fourth stretch across a heated plate set to 140 degrees C. at a stretch ratio of 1.08:1 with a stretch rate of 1.8%/sec. The stretched filament was then folded through a 2.0 mm wide eyelet. The folded filament possessed the following properties: width of 1.5 mm, height of 0.043 mm, weight per length of 371 dTex, bulk density of 0.58 g/cc, porosity of 38%, break strength of 20.11 N, tenacity of 5.42 cN/dTex, tensile strength of 0.51 GPa, and elongation at maximum load of 2.6%.

This filament was easy to grip and glided easily between teeth without any tendency to shred or break while flossing. Furthermore, the porosity in the filament provided for less stiffness of the filament and provided additional comfort to the gums as well as made the filament more comfortable to grip.

Inventive Example C

A PE membrane including UHMWPE and measuring 107 millimeters wide, 20 microns thick, and an area density of 8.5 grams per square meter with a porosity of 57.8% was obtained. This membrane was then slit to create a 6.9 mm wide cross section. The slit membrane was then stretched across a heated plate set to 120 degrees C. at a stretch ratio of 1.10:1 with a stretch rate of 3.1%/sec. This first stretch was followed by a second stretch across a heated plate set to 120 degrees C. at a stretch ratio of 1.10:1 with a stretch rate of 1.4%/sec. This second stretch was followed by a third stretch across a heated plate set to 120 degrees C. at a stretch ratio of 1.05:1 with a stretch rate of 0.7%/sec. This third stretch was followed by a fourth stretch across a heated plate set to 120 degrees C. at a stretch ratio of 1.05:1 with a stretch rate of 0.8%/sec. This fourth stretch was followed by a fifth stretch across a heated plate set to 120 degrees C. at a stretch ratio of 1.05:1 with a stretch rate of 0.6%/sec. The filament possessed the following properties: width of 3.1 mm, height of 0.023 mm, weight per length of 410 dTex, bulk density of 0.58 g/cc, porosity of 38%, break strength of 24.95 N, tenacity of 6.09 cN/dTex, tensile strength of 0.57 GPa, and elongation at maximum load of 11.4%.

This filament was easy to grip and glided easily between teeth without any tendency to shred or break while flossing. Furthermore, the porosity in the filament provided for less stiffness of the filament and provided additional comfort to the gums as well as made the filament more comfortable to grip.

Inventive Example D

A PE filament including UHMWPE was produced in the same manner as Example C, except the stretched filament was subsequently folded by running through a 2.0 mm wide eyelet. The folded filament possessed the following properties: width of 1.6 mm, height of 0.049 mm, weight per length of 409 dTex, bulk density of 0.52 g/cc, porosity of 45%, break strength of 24.78 N, tenacity of 6.06 cN/dTex, tensile strength of 0.57 GPa, and elongation at maximum load of 11.9%.

This filament was easy to grip and glided easily between teeth without any tendency to shred or break while flossing. Furthermore, the porosity in the filament provided for less stiffness of the filament and provided additional comfort to the gums as well as made the filament more comfortable to grip. This filament represents an improved floss over Example C from the ease of use stand point and a feeling of more overall effectiveness due to the changes in thickness and width caused by the subsequent folding by running through the 2.0 mm wide eyelet.

Inventive Example E

A PE filament including UHMWPE was produced in the same manner as Example D, except the folded filament was subsequently twisted at 630 turns per meter through a ring twister. The twisted filament possessed the following properties: diameter of 0.31 mm, weight per length of 477 dTex, bulk density of 0.63 g/cc, porosity of 33%, break strength of 15.44 N, tenacity of 3.24 cN/dTex, tensile strength of 0.30 GPa, and elongation at maximum load of 14.8%.

This twisted filament was easy to grip and glided easily between teeth without any tendency to shred or break while flossing. Furthermore, the porosity in the filament provided for less stiffness of the twisted filament and provided additional comfort to the gums as well as made the filament more comfortable to grip. This twisted filament may be preferred in applications where a round filament is desired over a more rectangular or ribbon shape.

Inventive Example F

A PE membrane including UHMWPE and measuring 500 millimeters wide, 30 microns thick and an area density of 18.1 grams per square meter with a porosity of 36% was obtained. This membrane was subsequently stretched in the machine direction through a hot air dryer set to 120 degrees Celsius at a stretch ratio of 2:1 with a stretch rate of 4.3%/second. This machine-direction stretch was followed by a transverse-direction stretch in an oven at 130 degrees Celsius at a ratio of 4.7:1 with a stretch rate of 15.6%/second. The resulting membrane possessed the following properties: width of 697 millimeters, thickness of 14 microns, porosity of 66%, and maximum load of 7.65 Newtons×6.23 Newtons and elongation at maximum load of 25.6%×34.3% in the machine direction and transverse directions respectively as tested according to ASTM D412. The membrane had a Gurly Time of 15.7 seconds. Gurley Time is defined as the number of seconds required for 100 cubic centimeters (1 deciliter) of air to pass through 1.0 square inch of a given material at a pressure differential of 4.88 inches of water (0.176 psi) (ISO 5636-5:2003).

A 5.1 mm filament was slit from this membrane. This slit filament was subsequently folded through a 1.0 mm wide eyelet. The folded filament possessed the following properties: width of 1.3 mm, height of 0.075 mm, weight per length of 228 dtex, bulk density of 0.23 g/cc, porosity of 75%, break strength of 6.23 N, tenacity of 2.74 cN/dtex, tensile strength of 0.26 GPa, and elongation at maximum load of 19.4%.

This filament was easy to grip and glided easily between teeth without any tendency to shred or break while flossing. Furthermore, the porosity in the filament provided for less stiffness of the filament and provided additional comfort to the gums as well as made the filament more comfortable to grip.

Inventive Example G

A 7.6 mm filament was slit from the membrane of Example F. This slit filament was subsequently folded through a 1.0 mm wide eyelet. The folded filament possessed the following properties: width of 1.4 mm, height of 0.095 mm, weight per length of 340 dtex, bulk density of 0.26 g/cc, porosity of 72%, break strength of 9.21 N, tenacity of 2.71 cN/dtex, tensile strength of 0.25 GPa, and elongation at maximum load of 18.2%.

This filament was easy to grip and glided easily between teeth without any tendency to shred or break while flossing. Furthermore, the porosity in the filament provided for less stiffness of the filament and provided additional comfort to the gums as well as made the filament more comfortable to grip.

Inventive Example H

An 8.9 mm filament was slit from the membrane of Example F. This slit filament was subsequently folded through a 2.0 mm wide eyelet. The folded filament possessed the following properties: width of 1.7 mm, height of 0.110 mm, weight per length of 420 dtex, bulk density of 0.22 g/cc, porosity of 77%, break strength of 13.2 N, tenacity of 3.15 cN/dtex, tensile strength of 0.30 GPa, and elongation at maximum load of 26.0%.

Figure 2:
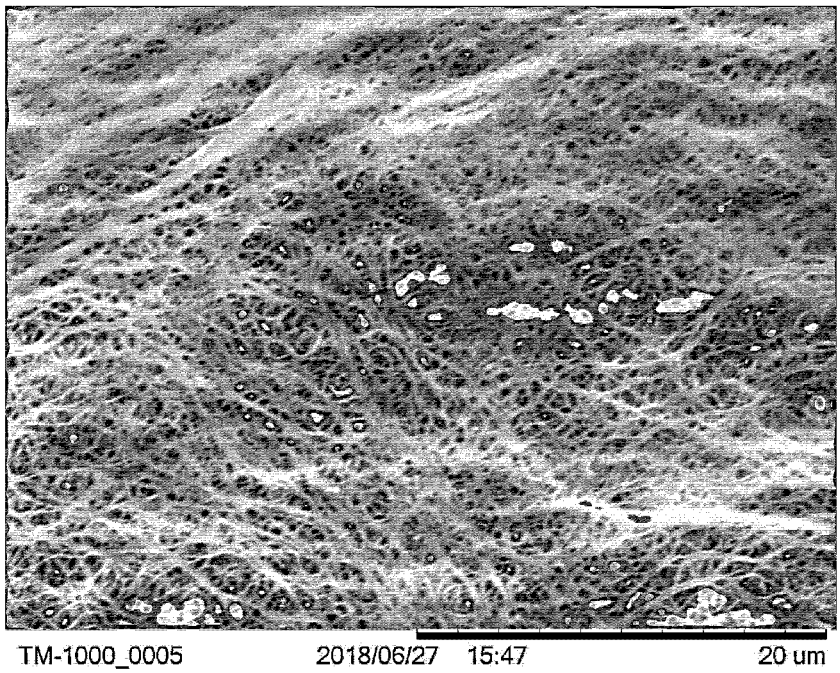
FIG. 2 is a scanning electron microscope (SEM) image of a filament in accordance with Inventive Example H below.

FIG. 2 is a scanning electron microscope (SEM) image of this filament at a 5000:1 magnification. The microporous nature of the filament can be clearly seen in the SEM image.

This filament was easy to grip and glided easily between teeth without any tendency to shred or break while flossing. Furthermore, the porosity in the filament provided for less stiffness of the filament and provided additional comfort to the gums as well as made the filament more comfortable to grip.

Comparative Example Z

An SEM image was taken of the microporous ePTFE filament used to make commercial dental floss. The filament possessed the following properties: width of 2.1 mm, height of 0.103 mm, weight per length of 1030 dtex, bulk density of 0.48 g/cc, porosity of 78%, break strength of 19.13 N, and a tenacity of 1.86 cN/dtex.

Figure 3:
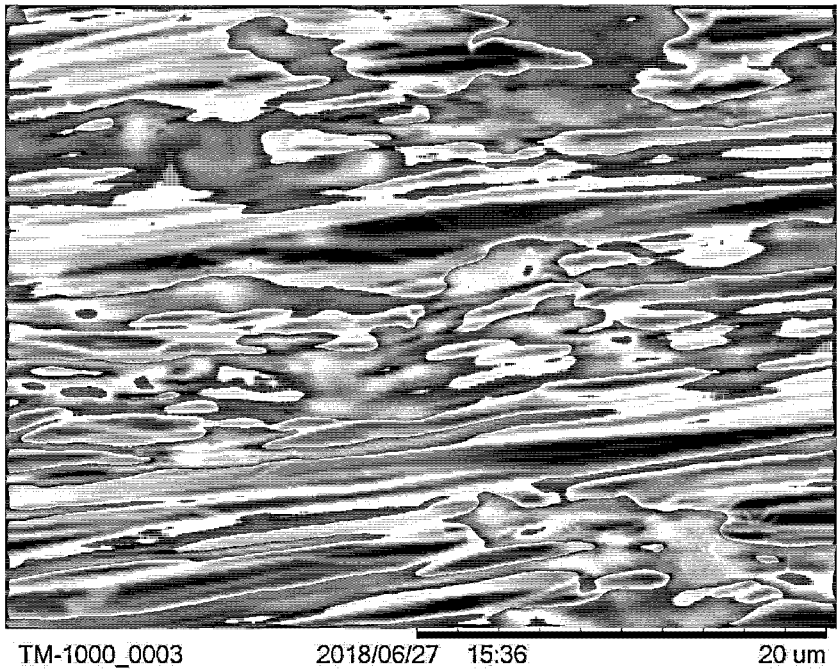
FIG. 3 is a SEM image of a filament in accordance with Comparative Example Z below.

FIG. 3 is a scanning electron microscope (SEM) image of this filament at a 5000:1 magnification. The microporous nature of the filament can be clearly seen in the SEM image.

This filament was easy to grip and glided easily between teeth without any tendency to shred or break while flossing. Furthermore, the porosity in the filament provided for less stiffness of the filament and provided additional comfort to the gums as well as made the filament more comfortable to grip.

Inventive Example I

A polyethylene membrane measuring 1000 millimeters wide, 16.5 microns thick and an area density of 5.5 grams per square meter with a porosity of 64.5% was obtained. A 2.0 mm filament was slit from the membrane. This slit filament was subsequently folded through a 1.0 mm wide eyelet. The folded filament possessed the following properties: width of 0.8 mm, height of 0.060 mm, weight per length of 103 dtex, bulk density of 0.22 g/cc, porosity of 77%, break strength of 4.49 N, tenacity of 4.37 cN/dtex, tensile strength of 0.41 GPa, and elongation at maximum load of 71.5%.

Inventive Example J

A 3.8 mm filament was slit from the membrane of Example I. This slit filament was subsequently folded through a 1.0 mm wide eyelet. The folded filament possessed the following properties: width of 0.9 mm, height of 0.077 mm, weight per length of 186 dtex, bulk density of 0.27 g/cc, porosity of 71%, break strength of 8.41 N, tenacity of 4.55 cN/dtex, tensile strength of 0.43 GPa, and elongation at maximum load of 72.3%.

Inventive Example K

A 5.8 mm filament was slit from the membrane of Example I. This slit filament was subsequently folded through a 1.0 mm wide eyelet. The folded filament possessed the following properties: width of 1.0 mm, height of 0.115 mm, weight per length of 284 dtex, bulk density of 0.25 g/cc, porosity of 73%, break strength of 12.54 N, tenacity of 4.40 cN/dtex, tensile strength of 0.41 GPa, and elongation at maximum load of 74.9%.

This filament was easy to grip and glided easily between teeth without any tendency to shred or break while flossing. Furthermore, the porosity in the filament provided for less stiffness of the filament and provided additional comfort to the gums as well as made the filament more comfortable to grip. The filament was readily disposable.

Comparative Fabric Example Y

A 4 ply Nylon multifilament yarn having an overall weight per length of 367 dTex was obtained. This Yarn was woven in a 1×2 Twill pattern to produce a 254 cm wide woven fabric consisting of 48 picks per inch (ppi) by 48 ends per inch (epi) fabric. This converts to 18.9 picks per cm by 18.9 ends per cm. The following measurements were taken on this fabric: weight per area of 168 g/m$^2$, thickness of 0.54 mm, air permeability of 67 cubic feet per minute (cfm), wet pick up of 45 grams per square meter (gsm) yielding a wet pick up of 27%. The hand measured to be 248 g.

Inventive Fabric Example L

The 4 ply Nylon multifilament yarn having an overall weight per length of 367 dTex from Comparative Example Y was woven in the same 1×2 Twill pattern of Comparative Example Y except the 103 dTex inventive filament of Example I was substituted for every other weft yarn in the woven fabric. The following measurements were taken on this fabric: weight per area of 140 g/m$^2$, thickness of 0.54 mm, air permeability of 69 cubic feet per minute (cfm), wet pick up of 34 grams per square meter (gsm) yielding a wet pick up of 24%. The hand measured to be 238 g.

Inventive Fabric Example M

The 4 ply Nylon multifilament yarn having an overall weight per length of 367 dTex from Comparative Example Y was woven in the same 1×2 Twill pattern of Comparative Example Y except the 186 dTex inventive filament of Example J was substituted for every other weft yarn in the woven fabric. The following measurements were taken on this fabric: weight per area of 151 g/m$^2$, thickness of 0.54 mm, air permeability of 43 cubic feet per minute (cfm), wet pick up of 36 grams per square meter (gsm) yielding a wet pick up of 24%. The hand measured to be 359 g.

Inventive Fabric Example N

The 4 ply Nylon multifilament yarn having an overall weight per length of 367 dTex from Comparative Example Y was woven in the same 1×2 Twill pattern of Comparative Example Y except the 284 dTex inventive filament of Example K was substituted for every other weft yarn in the woven fabric. The following measurements were taken on this fabric: weight per area of 165 g/m$^2$, thickness of 0.56 mm, air permeability of 29 cubic feet per minute (cfm), wet pick up (WPU) of 38 grams per square meter (gsm) yielding a wet pick up of 23%. The hand measured to be 530 g.

The fabric properties from the prior Examples are summarized in Table 1 below.

TABLE 1

Fabric Properties

| Sample Description | Weight (gsm) | Thick (mm) | Air Perm (cfm) | WPU (g/m$^2$) | WPU (%) | Hand (g) |
|---|---|---|---|---|---|---|
| Comparative Example Y: 100% 367 dTex Nylon Control | 168 | 0.54 | 67 | 45 | 27 | 248 |
| Inventive Example L: 103 dTex ePE substitute every other weft | 140 | 0.54 | 69 | 34 | 24 | 238 |
| Inventive Example M: 186 dTex ePE substitute every other weft | 151 | 0.54 | 43 | 36 | 24 | 359 |
| Inventive Example N: 284 dTex ePE substitute every other weft | 165 | 0.56 | 29 | 38 | 23 | 530 |

There is a desire of consumers to wear garments made from the lightest weight possible fabrics that can minimize air permeability. It is also desirable for these low weight fabrics to possess low wet pick up properties. Furthermore, when these fabrics are very light weight, it can be desired to provide increased hand or stiffness of the fabric to give the wearer a sensation that the fabric or garment is substantial enough to provide an overall feeling of protection. Nylon yarns are considered in the apparel industry to provide excellent characteristics for these properties. Still, there is a desired improvement of these properties in the apparel industry.

In every case shown in Table 1 above, the inventive fabric of Inventive Examples L-N is lighter weight than the 100% Nylon control fabric of Comparative Example Y. In the case where the inventive fabric weight is closest to the control fabric there is a very large decrease in air permeability. In the case where there is a greater gap in fabric weight there is still a substantial drop in air permeability. In the case where there is the greatest difference in fabric weight there is a similar measurement in air permeability. Thus, in all cases the ability to provide a very low air permeability fora given light weight fabric is demonstrated.

In a similar fashion, in every case, these low air permeability per weight fabrics also demonstrate a lower wet pick up property. The lower the weight of the fabric, the lower the wet pick up. Also, in all cases, the inventive fabrics demonstrate a lower wet pick up in percentage per weight than the control fabric.

It can also be seen from Table 1 above that in the case where the fabric weight is closest to the control fabric there is a very large increase in hand. In the case where there is a greater gap in fabric weight there is still a substantial increase in hand. In the case where there is the greatest difference in fabric weight there is only a small drop in hand. Thus, in all cases the ability to provide more hand for a given weight of fabric versus the control is demonstrated.

The invention of this application has been described above both generically and with regard to specific embodiments. It will be apparent to those skilled in the art that various modifications and variations can be made in the embodiments without departing from the scope of the disclosure. Thus, it is intended that the embodiments cover the modifications and variations of this invention provided they come within the scope of the appended claims and their equivalents.

What is claimed is:

1. A microporous monofilament comprising:

a continuous polyethylene filament comprising ultra high molecular weight polyethylene (UHMWPE) including a comonomer in an amount from 0.001 mol % to 10 mol %, and comprising interconnected pores, having:
a width of 0.2 mm to 8.0 mm,
a thickness of 0.02 mm to 0.35 mm,
a porosity of 30% to 76%,
a tensile strength of 0.1 GPa to 1.5 GPa,
a break strength of 3 N to 50 N,
a tenacity of 0.5 cN/dTex to 20 cN/dTex,
an elongation at maximum load of 1% to 100%, and
a linear density of 90 dTex to 1040 dTex.

2. The microporous monofilament of claim 1, wherein the continuous polyethylene filament is a dental floss, a thread or a suture.

3. The microporous monofilament of claim 1, wherein the continuous polyethylene filament includes expanded UHMWPE.

4. A multifilament comprising a plurality of the microporous monofilaments of claim 1.

5. A fabric or article of manufacture comprising at least one microporous monofilament comprising ultra high molecular weight polyethylene (UHMWPE) including a comonomer in an amount from 0.001 mol % to 10 mol %, and comprising interconnected pores, the at least one microporous monofilament comprising a continuous polyethylene filament having:
a width of 0.2 mm to 8.0 mm,
a thickness of 0.02 mm to 0.35 mm, and
a porosity of 30% to 76%,
a tensile strength of 0.1 GPa to 1.5 GPa,
a break strength of 3 N to 50 N,
a tenacity of 0.5 cN/dTex to 20 cN/dTex,
an elongation at maximum load of 1% to 100%, and
a linear density of 90 dTex to 1040 dTex.

6. The fabric of claim 5, wherein the fabric further comprises one or more yarns.

7. The fabric of claim 6, wherein the one or more yarns are a monofilament yarn, a multifilament yarn or a combination thereof.

8. The fabric of claim 5, wherein the continuous polyethylene filament includes expanded UHMWPE.

9. The fabric of claim 5, wherein the plurality of the microporous monofilaments are in the form of a yarn.

10. A method of manufacturing a microporous monofilament comprising:

providing a polyethylene tape or membrane; and
cutting the tape or membrane into a monofilament,
wherein the monofilament comprises ultra high molecular weight polyethylene (UHMWPE) including a comonomer in an amount from 0.001 mol % to 10 mol %, and wherein the monofilament has a porosity of 30% to 76%,
a tensile strength of 0.1 GPa to 1.5 GPa,
a break strength of 3 N to 50 N,
a tenacity of 0.5 cN/dTex to 20 cN/dTex,
an elongation at maximum load of 1% to 100%, and
a linear density of 90 dTex to 1040 dTex, and comprising interconnected pores, and the method lacks any compression steps that would reduce the porosity.

11. The method of claim 10, further comprising expanding the polyethylene tape or membrane before the cutting step.

12. The method of claim 10, further comprising expanding the monofilament after the cutting step.

13. The method of claim 10, further comprising folding lengthwise the monofilament.

14. The method of claim 10, further comprising twisting the monofilament.

15. The method of claim 10, further comprising incorporating the monofilament into a fabric.

16. The method of claim 10, further comprising forming the polyethylene tape by paste-processing or by gel-processing.

* * * * *